United States Patent [19]

Dingman

[11] Patent Number: 4,748,842

[45] Date of Patent: Jun. 7, 1988

[54] SHEET METAL PULLING APPARATUS

[76] Inventor: Boyd W. Dingman, 1004 E. Bremer, Waverly, Iowa 50677

[21] Appl. No.: 935,967

[22] Filed: Nov. 28, 1986

[51] Int. Cl.[4] ..... B21D 1/12

[52] U.S. Cl. ..... 72/457; 72/705

[58] Field of Search ..... 72/705, 457; 114/200; 24/116 R; 410/10, 11, 23, 101-103, 116; 52/704

[56] References Cited

U.S. PATENT DOCUMENTS

| | | | |
|---|---|---|---|
| 2,179,564 | 11/1939 | Smith | 24/116 R |
| 3,611,949 | 10/1971 | Peisner | 410/10 |
| 3,820,817 | 6/1974 | Harold | 410/23 |
| 4,057,994 | 11/1977 | Wolgast et al. | 72/705 |
| 4,186,464 | 2/1980 | Sandoy | 114/200 |

FOREIGN PATENT DOCUMENTS

| | | | |
|---|---|---|---|
| 33903 | 11/1964 | German Democratic Rep. | 114/200 |
| 346213 | 4/1931 | United Kingdom | 114/200 |

OTHER PUBLICATIONS

Hilti Drop-In Anchor, By Hilti Fastening Systems.
Kansas Jack, Inc., "Master Catalog", p. 10, Jan. 1977.
Kansas Jack, Inc., "Collision Repair Equipment" Catalog p. 19.
Nike Hydraulics, "One Man and Nike Hydraulic Dataliner" brochure; catalog No. 164E.
Buske Industries, Inc., Body Shop Catalog, Buske Collision Repair Systems, Buske Industries, Inc., Gowrie, Iowa 50543 (1982).
Buske Industries, Inc., Body Shop User Net and Package Plan Price List No. 887C, Buske Industries, Inc. Gowrie, Iowa 50543 (1983).
Kuhn Manufacturing Co., Inc., Kuhn Catalog, Kuhn Manufacturing Co., Inc., Sun Valley, California 91352.

*Primary Examiner*—Lowell A. Larson
*Attorney, Agent, or Firm*—Henderson & Sturm

[57] ABSTRACT

A sheet metal pulling apparatus in combination with a plurality of anchors disposed at spaced locations in the floor of a body shop; wherein, the sheet metal pulling apparatus comprises: a base member having a vertically extending post; a tie down plate; and a chain operatively secured to both the base member and the tie down plate; wherein the chain is selectively engaged by a removable pin which is operatively attached to the tie down plate; whereby, tension can be maintained between the base member and the tie down plate when the vertically extending post of the base member is connected to a winch which is subsequently attached to the sheet metal surface of a vehicle.

1 Claim, 1 Drawing Sheet

SHEET METAL PULLING APPARATUS

TECHNICAL FIELD

The present invention relates generally to a sheet metal pulling apparatus and more particularly to such an apparatus for us in pulling dents or the like from motor vehicles.

BACKGROUND ART

Vehicle body repair shops have many different types of equipment for straightening and repairing vehicles bodies. For example, some stalls in body shops have large frame machines upon which a vehicle is loaded and which use hydraulic rams or other devices for pulling dents out of vehicles for straightening the frame of the vehicle. These frame machines are expensive and normally are used for extensive damage, rather than for small dents or the like. Other stalls in body shops have tie downs in the floor and floating posts having hydraulic rams thereon, which is a cheaper solution to the repair process, but not as efficient a process as the use of a frame machine.

Cost conscious shop owners realize how costly it can be to move vehicles which have only a small dent therein to a frame machine or to a stall with tie downs. The set up time is very slow in such stalls or frame machines and the high investment costs of such structures can best be justified only for larger jobs. Consequently, there is a need for a much less expensive, yet versatile approach for pulling out small dents in vehicles.

DISCLOSURE OF THE INVENTION

The present invention relates to a sheet metal pulling apparatus having a plurality of internally threaded anchors disposed at spaced relationships in the floor of a body shop. A base member having a vertically extending post thereon is slideable to various positions on the floor and has a bracket which can be adjusted vertically on the post. A tie down plate has a central hole therethrough and a pair of upstanding flanges rigidly connected thereto on each side of the central hole. These flanges have aligned holes therein.

A chain having a plurality of interlocked links is connected at one end to one end of the bracket on the post and the other end of the chain is held underneath a pin extending through the holes in the upstanding flanges. The distance between the bottom of the pin and the top of the plate is less than the width of one of the interlocked links. One of the interlocked links near one end of the chain is entirely below the bottom of the pin and the interlocking links immediately to each side of such one interlocked link are disposed at least partially above the bottom of the pin whereby the chain will be essentially prevented from pulling away from the tie down plate when the pin is in place over one of the interlocking links. The anchor plate itself is bolted down to one of the anchors in the floor by placing a bolt through the central opening in the anchor plate and threading it into one of the internally threaded floor anchors. A hand operated winch has one end connected to the other end of the bracket on the upstanding post and the other end of the winch is connected to the sheet metal of a vehicle which needs to be pulled.

An object of the present invention is to provide an improved sheet metal pulling apparatus.

A further object of the present invention is to provide a sheet metal pulling apparatus which is economical to install and easy to use.

A further object of the present invention is to provide a chain adjusting mechanism which is economical to produce and easy to use.

Other objects, advantages and novel features of the present invention will become apparent from the following detailed description of the invention when considered in conjunction with the accompanying drawings.

BEST MODE FOR CARRYING OUT THE INVENTION

Figure 1:
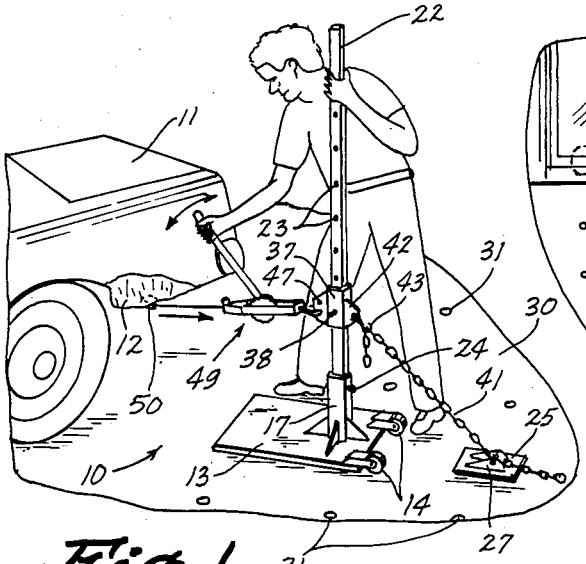
FIG. 1 is a perspective view of a preferred embodiment of the present invention in use pulling a dent out of an automobile.

Referring now to the drawings wherein like reference numerals designate identical or corresponding parts throughout the several views, FIG. 1 shows the apparatus (10) of the present invention being used on an automobile (11) to pull out a dented portion (12) thereof.

A base member (13) has a pair of rollers (14) rotatably attached to flanges (16) which are welded to the base plate (13). An upstanding square tubular member (17) is welded to the base member (13) and has a plurality of braces (18) also welded thereto and to the base member (13). A hole (19) extends through the upstanding tubular member (17) at a height to mate with opening (21) in upstanding post (22). The upstanding post (22) also has a plurality of openings (23) extending therethrough. The post (22) is made collapsable with respect to the member (17) for shipping purposes but when the device is utilized, and the post (22) is pushed down into the tube (17), the bottom of the post (22) will rest on the top of the base (13) and a pin (24) will be pushed through holes (19) and (21) to hold the post (22) securely in a vertical position with respect to the anchor plate (13).

Figure 4:
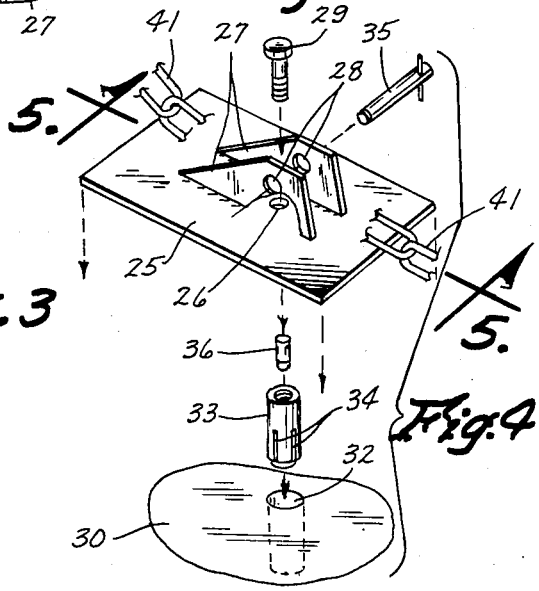
FIG. 4 is an enlarged exploded perspective view of the anchor plate and anchor portion of the embodiment of the present invention.

Referring to FIG. 4, it is noted that an anchor plate (25) has a central hole (26) therethrough and a pair of flanges (27) welded therethrough on each side of the central hole (26). The flanges (27) have aligned holes (28) therein.

The floor (30) which is made of concrete, has a plurality of anchors (31) positioned therein by first boring a hole (32) in the concrete (30), inserting a metal anchor (33) having slots (34) in the bottom thereof and then driving a wedge (36) with a punch or the like to cause the lower portion on each side of slots (34) to push outwardly against the bottom of the hole (32) to hold the anchor (33) in position. Other types of internally threaded floor anchors could be used however, if desired.

In order to utilize the preferred embodiment of the invention (10) a bracket (37) is slideably placed over the top of the post (22) and is moved downwardly until it is approximately at the same level as the dent (12) of the automobile (11). Then it is aligned with the one of the openings (23) which is closest thereto and a pin (38) is pushed through openings (39) in the bracket (37) and through the holes (23) in post (22) to hold the bracket (37) in such vertical position.

A chain (41) having interlocking metal links thereon is attached to a flange (42) by a combination hook and clasp structure (43) by extending a pin (44) through an opening (45) in the flange (42) and through openings in the end of hook and clasp (43). One of the links (41) has the hook extending therethrough. The other side of the bracket (37) has a flange (46) thereon with a pair of openings (47) therethrough. A hook (48) on a hand operated winch (49) extends through one of the openings (47) at one end thereof and the other end of the winch has a hook or other attachment mechanism (50) thereon for attachment to the dented portion (12) of the vehicle (11). The chain (41) can be tightened to the position shown in FIG. 1 by hoisting it between the flanges (27), pulling it to the desired tightness, and then inserting a pin (35) through openings (28) in flanges (27) and across the top of one of the links (41), for example as shown in FIG. 5.

Figure 2:
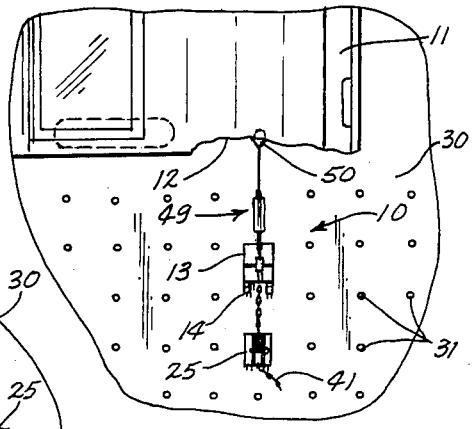
FIG. 2 is a top view of the apparatus shown in FIG. 1 ready to be used.
Figure 3:
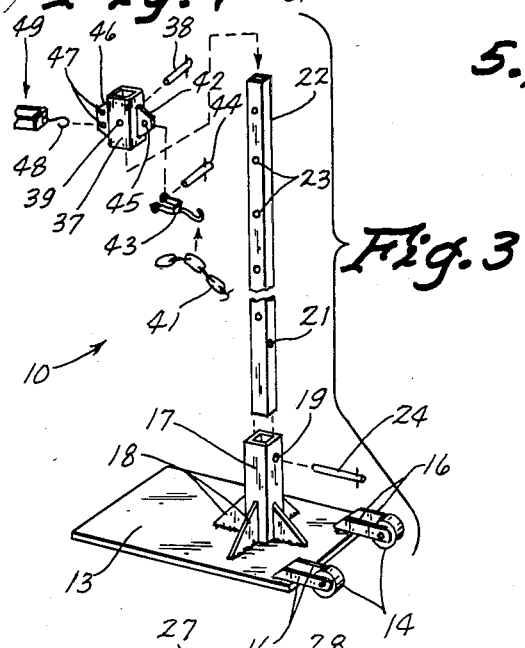
FIG. 3 is an enlarged exploded view of the post portion of the present invention.
Figure 5:
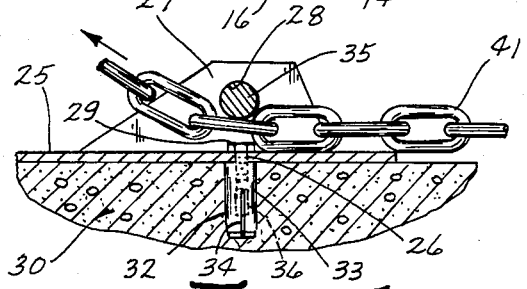
FIG. 5 is a cross sectional view taken along line 5—5 and showing how the anchor plate is secured to an anchor in a concrete floor of a body shop.

The space between the bottom of the pin (35) as shown in FIG. 5 and the top of the plate of the anchor plate (13) is less than the width of one of the links (41) so that when one of the links (41) is held under the pin (35), one of the adjacent links (41), for example, the one immediately to the right of pin (35) as shown in FIG. 5, cannot be pulled between the pin (35) and the anchor plate (13). This produces a quicker and faster adjustment of the chain that if a smaller pin were used to extend through one of the links (41) of the chain. Also in FIG. 5, it is noted that a bolt (29) is utilized to hold the anchor plate (13) in place on any one of the positions of the anchors (31), for example as shown at various locations in FIGS. 1 and 2.

Once the preferred embodiment of the present invention is set up in the position shown in FIG. 1, then the handle of the come-along winch (49) is used to ratchet a cable connected to the hook (50) to pull the dented portion (12) of the automobile (11) outwardly toward the post (22). This particular arrangement allows a body shop operator to pull dents at various locations on the automobile (11) without moving such automobile (11), but instead by merely re-positioning the apparatus (10) shown in FIG. 1.

Obviously many modifications and variations of the present invention are possible in light of the above teachings. It is therefore to be understood that, within the scope of the appended claims, the invention may be practiced otherwise than as specifically described.

I claim:

1. A sheet metal pulling apparatus consisting of:

a floor;

a base member adapted to rest on said floor;

a post member having a plurality of vertically spaced apart holes in said post member;

means attached to said post member and to said base member for holding said post member in a vertical position;

a plurality of anchors disposed at spaced apart positions in said floor, said anchors being flush with the top of the floor and being internally threaded;

a bracket vertically slidably disposed on said post member, said bracket having openings therein alignable with the holes in said post member;

a pin means for being selectively receivable through the opening in the bracket and a selected one of the holes in said post member for holding said bracket at a desired vertical level on said post member;

a tie down plate having a central hole therethrough and a pair of upstanding parallel flanges rididly connected thereto on each side of said central hole, said upstanding flanges having a pair of laterally aligned holes therein;

a bolt for extending through the central hole in the tie down plate and threadeably engaging one of said anchors;

a chain comprised of a plurality of interlocked links, adjacent ones of said interlocked links being disposed in planes generally perpendicular to each other;

a pin axially extending through the laterally aligned holes in said upstanding flanges, the distance between the bottom of the pin and the top of said plate being less than the width of one of said interlocked links, one of the interlocking links near one end of said chain being entirely below the bottom of said pin and the interlocked links immediately to each side of said one interlocked link being disposed at least partly above the bottom of said pin whereby said chain will be essentially prevented from pulling away from said tie down plate when said pin is in place over said one interlocked link;

means connected to one side of said bracket for connecting the other end of the chain thereto;

a hand operated winch means for exerting a pulling force between said tie down plate and a sheet metal part;

means connected to the other side of said bracket for connecting one end of said winch means thereto; and means attached to the other end of said winch means for connection to a sheet metal part on a vehicle.

* * * * *